US007416384B2

(12) United States Patent
Tokuda et al.

(10) Patent No.: US 7,416,384 B2
(45) Date of Patent: Aug. 26, 2008

(54) ELECTRIC BLOWER AND VACUUM CLEANER USING SAME

(75) Inventors: Tsuyoshi Tokuda, Hikone (JP); Yoshitaka Murata, Hikone (JP); Yoshitaka Hayamizu, Kadoma (JP); Kazuhisa Morishita, Yokaichi (JP); Yasuhiro Yuasa, Yokaichi (JP); Norihiro Tsuchiya, Omihachiman (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 457 days.

(21) Appl. No.: 10/664,975

(22) Filed: Sep. 22, 2003

(65) Prior Publication Data

US 2004/0123482 A1 Jul. 1, 2004

(30) Foreign Application Priority Data

Sep. 20, 2002 (JP) ..... 2002-274546
Nov. 19, 2002 (JP) ..... 2002-334842

(51) Int. Cl.
*A47L 5/22* (2006.01)
*A47L 9/22* (2006.01)

(52) U.S. Cl. ..... 415/203; 415/206; 417/423.1; 417/423.2

(58) Field of Classification Search ..... 415/203, 415/206; 417/423.1–423.2
See application file for complete search history.

(56) References Cited

U.S. PATENT DOCUMENTS 4,057,370 A 11/1977 Numata et al.
4,808,090 A 2/1989 Evans
6,166,462 A 12/2000 Finkenbinder et al.

FOREIGN PATENT DOCUMENTS

| | | |
|---|---|---|
| DE | 19606146 | 8/1997 |
| EP | 1 048 258 | 11/2000 |
| EP | 1 138 242 | 10/2001 |
| JP | 61-47964 | 3/1986 |
| JP | 3-18699 | 1/1991 |
| JP | 2001-342996 | 12/2001 |
| JP | 2002-21794 | 1/2002 |
| JP | 2002-31084 | 1/2002 |
| JP | 2002-78649 | 3/2002 |
| WO | 97/19629 | 6/1997 |
| WO | 98/38899 | 9/1998 |

*Primary Examiner*—Shay L Karls
(74) *Attorney, Agent, or Firm*—Bacon & Thomas, PLLC

(57) ABSTRACT

An electric blower includes an electric motor including a stator and a rotor. The impeller is rotated by the electric motor. An air guide having a plurality of guide blades is disposed around the impeller, and a casing encloses the impeller and the air guide. The casing is provided with a number of exhaust openings through which a part of an air stream suctioned by the impeller is discharged, and a circumferential length of each of the exhaust openings is substantially identical to a circumferential distance between outer peripheral ends of adjacent guide blades. Alternatively, the circumferential length of each of the exhaust openings may be less or greater than the circumferential distance between outer peripheral ends of adjacent guide blades.

22 Claims, 14 Drawing Sheets

ELECTRIC BLOWER AND VACUUM CLEANER USING SAME

FIELD OF THE INVENTION

The present invention relates to an electric blower and a vacuum cleaner incorporating same.

BACKGROUND OF THE INVENTION

Referring to FIG. 18, there is illustrated a conventional electric blower 1 including motor unit 2 having rotation shaft 3; and impeller 4 secured to rotation shaft 3. Disposed along and facing the outer periphery of impeller 4 is air guide 5. Reference numeral 6 is a casing air-tightly adjoined with the outer periphery of motor unit 2, the casing enclosing impeller 4 and air guide 5 and having intake opening 6*a* at the center thereof. Formed along the circumference of casing 6 is a plurality of first exhaust openings 7. Further, one or more second exhaust openings 9 are formed in bracket 14' accommodating motor unit 2.

The electric blower configured as described above operates as follows. Impeller 4 mounted on rotation shaft 3 of motor unit 2 rotates at a high speed thereby generating suction air stream. Thus created suction air stream travels into air guide 5 from the outer periphery of impeller 4. Some of the suction air stream entering air guide 5 is discharged through first exhaust openings 7 formed in casing 6, and the rest is exhausted through second exhaust openings 9 in bracket 14' (see, e.g., Japanese Utility Model Laid-open Publication No. 1986-47964).

It is well known in the art that an air blowing efficiency of electric blower 1 can be improved by releasing some of the suction air stream through the periphery of casing 6, as described above. However, a specific shape and area of first exhaust openings 7 and their positions relative to air guide 5 for further enhancing the efficiency of the electric blower have not been studied in detail.

SUMMARY OF THE INVENTION

It is, therefore, an object of the present invention to provide an electric blower featuring an improved air blowing efficiency and a vacuum cleaner incorporating same.

In accordance with an aspect of the present invention, there is provided an electric blower comprising: an electric motor including a stator and a rotor; an impeller being rotated by the electric motor; an air guide having a plurality of guide blades around the impeller; and a casing enclosing the impeller and the air guide, wherein the casing is provided with a number of exhaust openings through which a part of an air stream suctioned by the impeller is discharged, and a circumferential length of each of the exhaust openings is substantially identical to a circumferential distance between outer peripheral ends of adjacent guide blades.

In accordance with another aspect of the present invention, there is provided an electric blower comprising: an electric motor including a stator and a rotor; an impeller being rotated by the electric motor; an air guide having a plurality of guide blades around the impeller; and a casing enclosing the impeller and the air guide, wherein the casing is provided with a number of exhaust openings through which a portion of an air stream suctioned by the impeller is discharged, and a circumferential length of each of the exhaust openings is less than a circumferential distance between outer peripheral ends of adjacent guide blades.

In accordance with still another aspect of the present invention, there is provided an electric blower comprising: an electric motor including a stator and a rotor; an impeller being rotated by the electric motor; an air guide having a plurality of guide blades around the impeller; and a casing enclosing the impeller and the air guide, wherein the casing is provided with a number of exhaust openings through which a part of an air stream suctioned by the impeller is discharged, and a circumferential length of each of the exhaust openings is greater than a circumferential distance between outer peripheral ends of adjacent guide blades.

In accordance with still further another aspect of the present invention, there is provided an electric blower comprising: a stator and a rotor; an impeller fixedly installed on a rotation shaft of the rotor; a casing enclosing the impeller, wherein the casing is provided with a plurality of exhaust openings through which a part of an air stream suctioned by the impeller is discharged, each of the exhaust openings being in a form of a hole.

In accordance with still further another aspect of the present invention, there is provided a vacuum cleaner comprising: a main body incorporating therein a suction inlet for suctioning dust and an electric blower for generating an air suction stream; an outlet through which air discharged from the electric blower is exhausted outside; a control unit for controlling an operation of the electric blower, wherein the electric blower including an impeller for generating the air suction stream by the rotation thereof, a casing enclosing the impeller, and exhaust openings formed in the casing through which a part of an air stream suctioned by the impeller is discharged; and the control unit is disposed on an air path between the exhaust openings and the outlet.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF PREFERRED EMBODIMENTS

Figure 1:
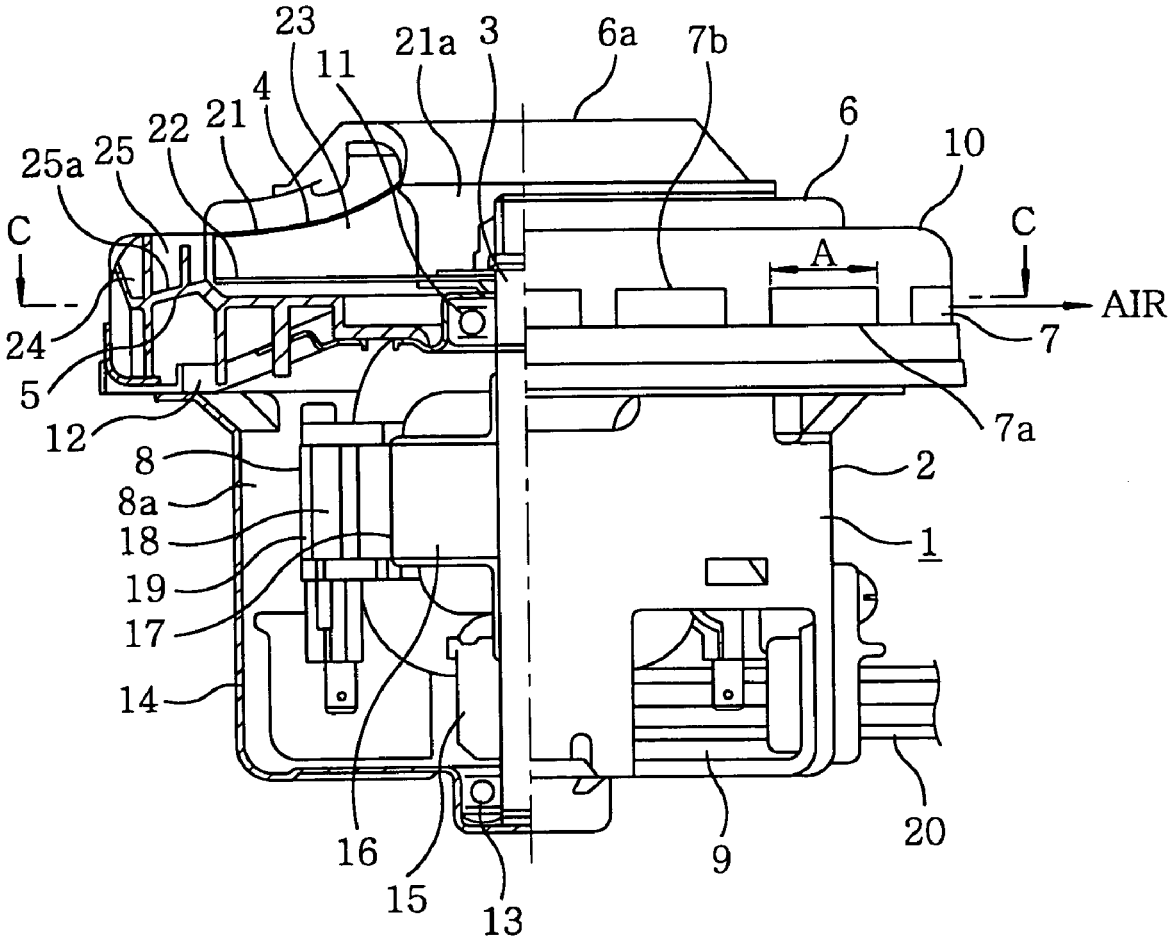
FIG. 1 is a half cutaway cross sectional view of an electric blower in accordance with a first preferred embodiment of the present invention.
Figure 2:
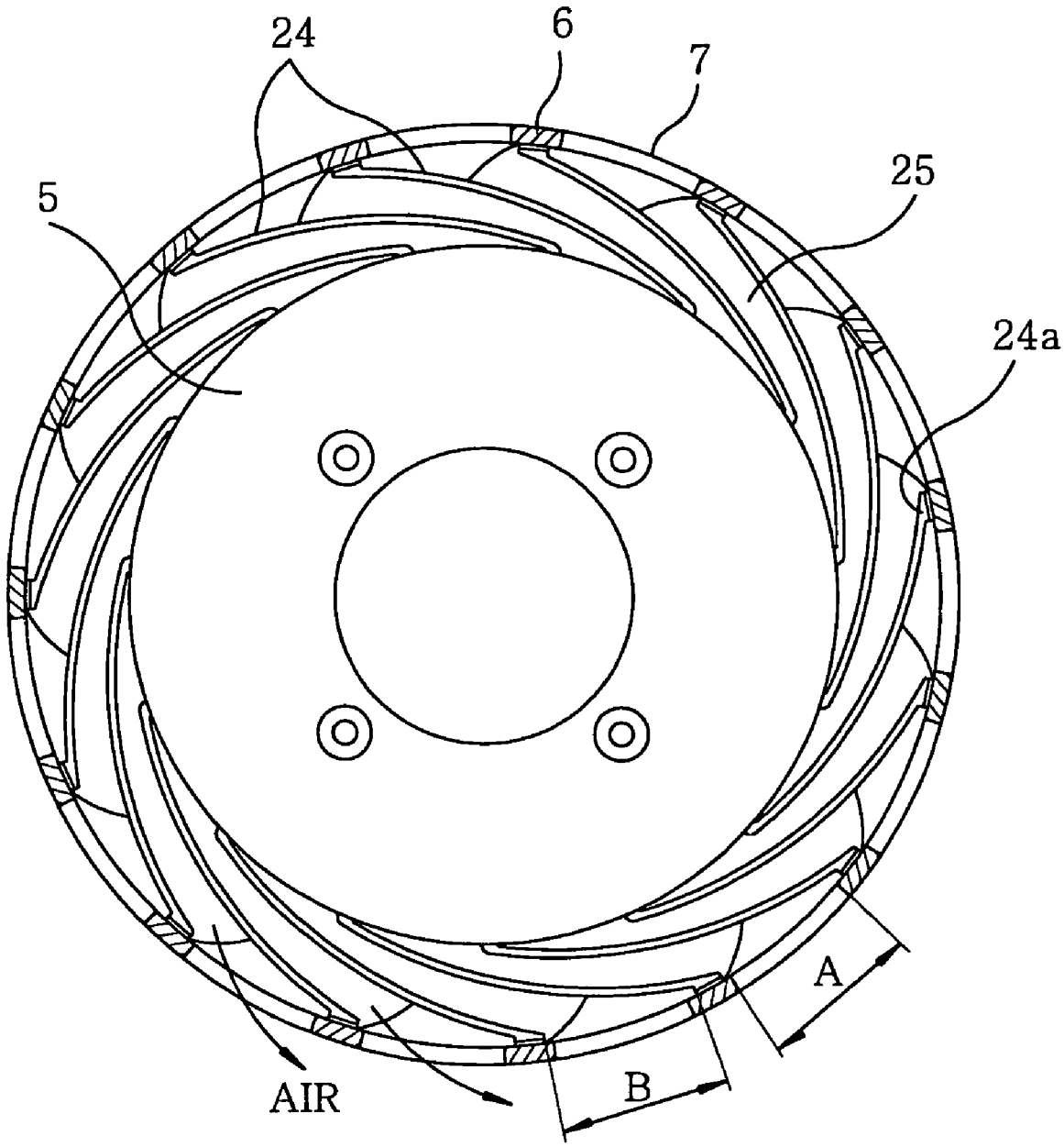
FIG. 2 provides a cross sectional view taken along line C-C in FIG. 1.
Figure 18:
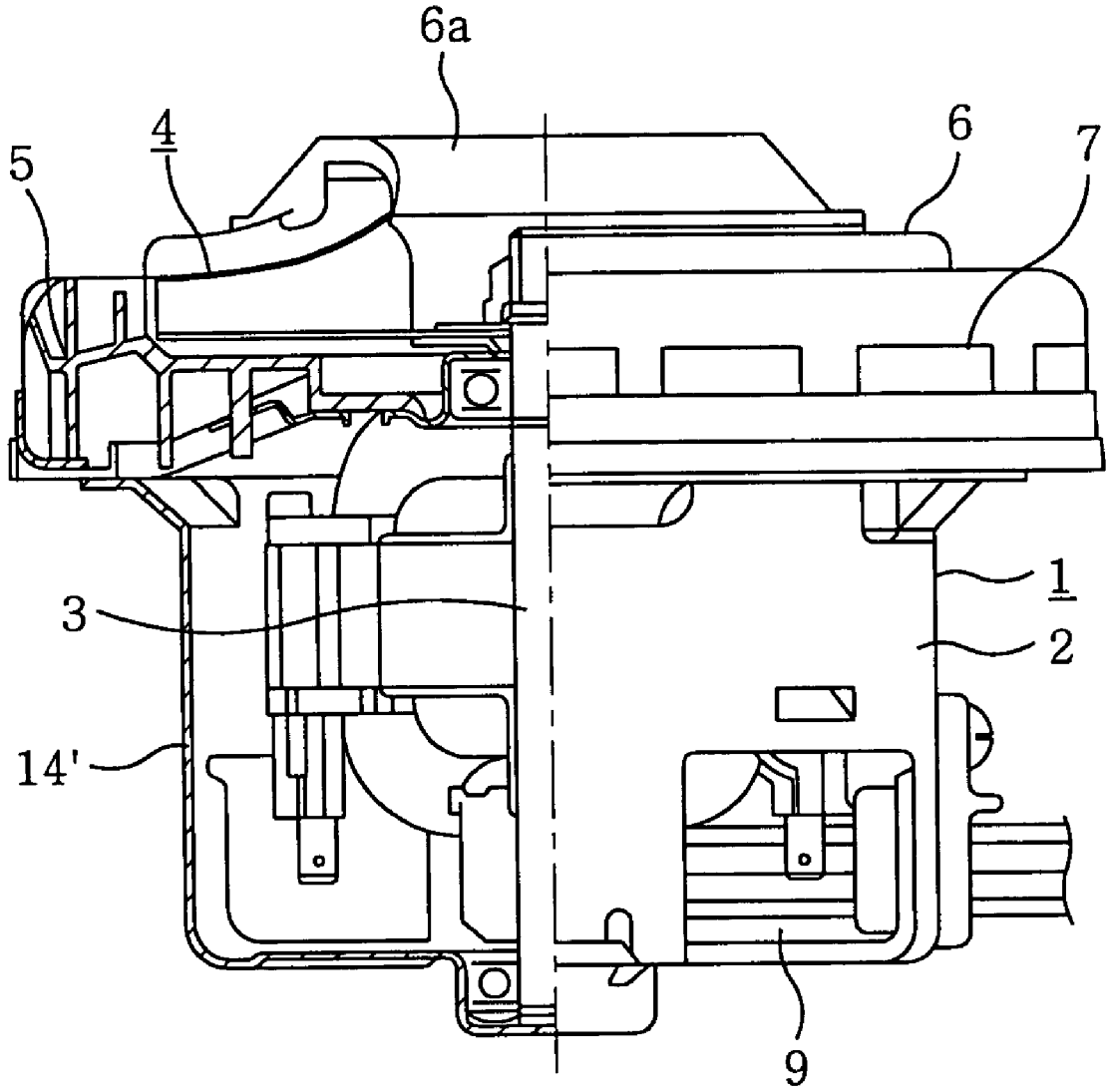
FIG. 18 provides a half cutaway cross sectional view of a conventional electric blower.

Referring to FIGS. 1 and 2, there is illustrated an electric blower in accordance with a first preferred embodiment of the present invention. Detailed explanations of parts identical or similar to those described in the conventional art in FIG. 18 will be omitted, and like reference numerals will be used therefor.

Reference numeral 1 represents electric blower including motor unit 2 and fan unit 10. Motor unit 2 is enclosed by first bracket 12 supporting bearing 11 on the near side of fan unit 10 and second bracket 14 supporting bearing 13 on the far side of fan unit 10. Second bracket 14 accommodates therein electric motor 8.

Electric motor 8 includes rotor 17 and stator 19. Rotor 17 has commutator 15 and armature core 16, both of which are press-fixed to shaft 3, armature core 16 being formed by laminating thin Si steel sheets and having windings (not shown) placed thereon. Stator 19 has field core 18 formed by stacking thin Si steel sheets, and windings (not shown) provided thereon. Further mounted on second bracket 14 is brush holder 20 for receiving therein a carbon brush (not shown) that slidably moves relative to commutator 15.

Fan unit 10 includes impeller 4 comprised of front shroud 21, rear shroud 22 and a plurality of blades 23 disposed therebetween. Impeller 4 is secured to rotation shaft 3. Front shroud 21 has inlet hole 21*a* formed at the center thereof. Further, provided along and around the outer periphery of impeller 4 is air guide 5 having volute chambers 25 formed by a number of guide blades 24. Reference numeral 6 is a casing air-tightly adjoined with second bracket 14, casing 6 enclosing impeller 4 and air guide 5 and having intake opening 6*a* at the center thereof. Formed along the circumference of casing 6 are first exhaust openings 7 through which a part of air stream from air guide 5 is discharged. Further, at least one second exhaust opening 9 is formed in second bracket 14. Total area S5 of second exhaust openings 9 is set to be larger than total area S1 of first exhaust openings 7 (S5>S1).

Circumferential length A of each of first exhaust openings 7, i.e., a length thereof measured along the circumference of casing 6, is set to be substantially identical to circumferential distance B between two adjacent guide blades 24 at the outer periphery thereof. That is, first exhaust openings 7 of a substantially rectangular shape are formed along the circumference of casing 6 such that each of first exhaust openings 7 is aligned with a circumferential gap between the outer peripheral ends of adjacent guide blades 24. That is, each of first exhaust openings 7 is disposed in such a manner that it faces one volute chamber 25.

Bottom surfaces 25*a* of volute chambers 25 are set to be located at a substantially identical level to those of lower edges 7*a* of first exhaust openings 7 or located between lower edges 7*a* and upper edges 7*b* thereof.

Each part of electric blower 1 is dimensioned such that total area S1 of first exhaust openings 7 is smaller than total cross sectional area S4 of air path 8*a* between second bracket 14 and electric motor 8 as measured in a direction perpendicular to rotation shaft 3 (S1<S4).

The operation of electric blower 1 configured as described above will now be described.

When the power is applied to the windings of stator 19 and the windings of rotor 17 via the carbon brush and commutator 15, rotation shaft 3 of rotor 17 and hence impeller 4 fixed thereto rotate at a high speed, thereby generating suction air stream. The suction air stream is sucked through inlet hole 21*a* formed at front shroud 21 of impeller 4 and travels through a passage surrounded by front and rear shroud 21, 22 and blades 23 to be exhausted from the periphery of impeller 4. The air stream released from impeller 4 passes through volute chambers 25 formed by adjacent guide blades 24, and is exhausted from the outer periphery of air guide 5.

A part of the air stream from air guide 5 is discharged to outside through first exhaust openings 7 formed at casing 6 and the rest of the air stream is released through second exhaust opening 9 formed at second bracket 14 after cooling down rotor 17, stator 19 and the like disposed therein.

Since the part of the suction air stream is directly exhausted to outside through first exhaust openings 7 provided at casing 6, pressure loss of the air stream due to a deflection of airflow occurring when the air stream is guided through volute chambers 25 of air guide 5 toward motor unit 2 can be reduced.

Further, since the volume of the air stream passing through motor unit 2 is reduced, pressure loss of the air stream due to flow resistance in that region (referred to as windage loss) can also be reduced. Accordingly, a gross fluidic loss, i.e., the pressure losses of the air stream due to the deflection of the airflow and the windage loss can be reduced, resulting in an increase in the overall blowing efficiency of electric blower 1.

Since, in the preferred embodiment, circumferential length A of each of first exhaust openings 7 is substantially identical to circumferential distance B between outer peripheral ends 24*a* of every two adjacent blades 24 and first exhaust openings 7 of a substantially rectangular shape are formed at casing 6 facing the outer peripheral ends of adjacent guide blades 24, the air streams flowing through volute chambers 25 are efficiently released through first exhaust openings 7 and, therefore, the volume of the air streams flowing toward motor unit 2 is reduced. As a result, the overall pressure loss (i.e. deflection loss and windage loss) is lessened, further increasing the blowing efficiency of electric blower 1.

Moreover, since bottom surfaces 25*a* of volute chambers 25 are set to be located at the substantially same level as lower edges 7*a* of first exhaust openings 7 or located between lower edges 7*a* and upper edges 7*b*, the air stream from impeller 4 is exhausted through first exhaust openings 7 without colliding with casing 6. Accordingly, the blowing efficiency of electric blower 1 can be increased and at the same time noise thereof can be reduced.

Furthermore, the number of volute chambers 25 is the same as that of first exhaust openings 7, as illustrated in FIG. 2, which contributes to the efficient exhausting of the air streams, resulting in an improvement in the blowing efficiency of electric blower 1.

Further, since total area S1 of first exhaust openings 7 is set to be smaller than total cross sectional area S4 of air path 8*a* between second bracket 14 and electric motor 8 as measured in the direction perpendicular to rotation shaft 3 (S1<S4), the air streams passing through volute chambers 25 can be easily flown toward electric motor 8 that tends to be hot, thereby cooling electric motor 8 and suppressing a temperature increase thereof.

S1 may be set to be equal to or greater than S4 (S1≧S4) if temperature rise of electric motor 8 is not a critical problem. In such a case, it becomes easier for the air streams from volute chambers 25 to exit through first exhaust openings 7, which causes less pressure loss of the air streams to increase air suction efficiency of electric blower 1.

Furthermore, since one or more second exhaust openings 9 are formed in bracket 14 enclosing electric motor 8, a portion of the air streams can be introduced into the interior of bracket 14 from impeller 4 to flow therethrough, thereby efficiently cooling electric motor 8.

Moreover, by setting total area S5 of second exhaust openings 9 larger than total area S1 of first exhaust openings 9 (S1<S5), the flow resistance of the airflow through second exhaust openings 9 can be reduced. Further, this configuration facilitates the flow of the air streams from volute chambers 25 toward electric motor 8 which tends to be hot, thereby suppressing a temperature rise thereof.

On the other hand, if S1 is set to be equal to or larger than S5 (S1≧S5), the air streams from volute chambers 25 can readily exit through first exhaust openings 7, which causes less pressure loss of the air streams to increase air suction efficiency of electric blower 1.

Figure 3:
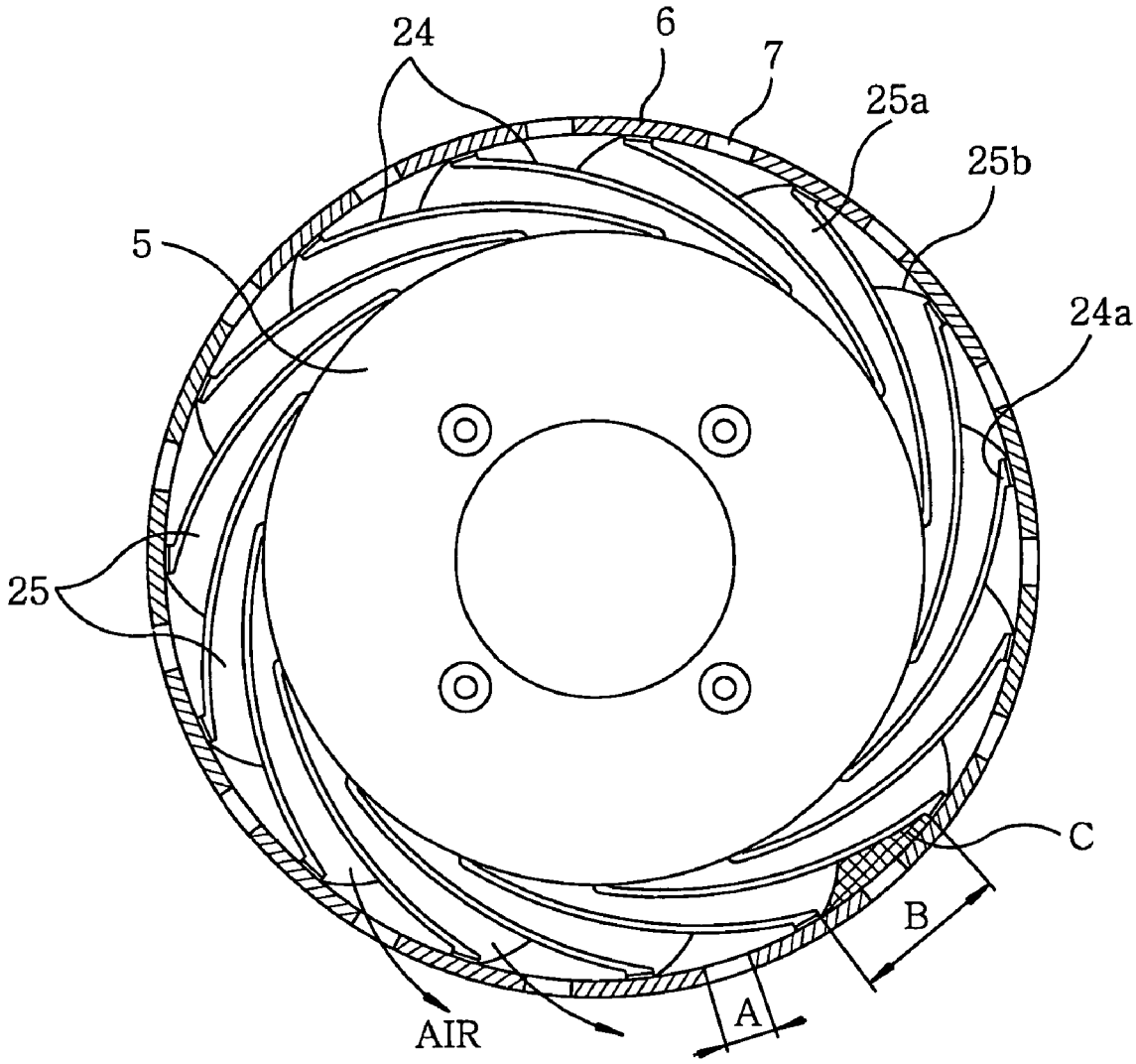
FIG. 3 sets forth a cross sectional view (taken along line C-C in FIG. 1) describing a positional relationship between guide blades and first exhaust openings in an electric blower in accordance with a second preferred embodiment of the present invention.

Next, a second preferred embodiment of the present invention will now be described in detail with reference to FIG. 3. Detailed explanations of parts that are identical or similar to those in the first embodiment will be omitted, and like reference numerals will be used therefor. In this preferred embodiment, circumferential length A of each of first exhaust openings 7 is reduced to be smaller than circumferential distance B between outer peripheral ends 24*a* of every two adjacent guide blades 24, and each of first exhaust openings 7 is disposed such that it is aligned with one of volute chambers 25.

Further, each of first exhaust openings 7 is disposed at about the center portion of corresponding volute chamber 25, and peripheral end portion 25*b* of each of volute chambers 25 is misaligned with its corresponding first exhaust opening 7.

Moreover, total area S1 of first exhaust openings 7 is set to be smaller than total area S2 of peripheral end portions 25*b* of volute chambers 25 (S1<S2).

Further, S1 is set to be smaller than total area S3 of air paths C (only one of which is hatched in the drawing for illustration) between air guide 5 and casing 6 (S1<S3).

When air streams are directly discharged through first exhaust openings 7, high frequency noises tend to increase. Accordingly, in the electric blower having the configuration as described above, since the total area of first exhaust openings 7 is set to be smaller, the volume of the air stream passing through motor unit 2 is increased, thereby resulting in suppression of high frequency noises. The same effects may be attained by reducing the number of first exhaust openings 7 or forming first exhaust openings 7 only along a half of the circumference of casing 6.

Further, peripheral end portions 25*b* of volute chambers 25 are disposed misaligned with corresponding first exhaust openings 7. With such arrangements, in case each of first exhaust openings 7 is smaller than peripheral end portion 25*b* of each of volute chambers 25, some of the high frequency noises are blocked by casing 6, thereby achieving high frequency noise reduction. On the other hand, if each of first exhaust openings 7 is set to be greater than peripheral end portion 25*b* of each of volute chambers 25, there occur interferences between air streams discharged from neighboring volute chambers 25, thereby reducing noises.

Further, since total area S1 of first exhaust openings 7 is set to be smaller than total area S2 of peripheral end portions 25*b* of volute chambers 25 (S1<S2), the air streams from volute chambers 25 easily flow toward motor unit 2 having less flow resistance than first exhaust openings 7. As a result, motor unit 2 that tends to be hot can be efficiently cooled by the air streams flowing therethrough.

Adversely, in case S1 is set to be equal to or greater than S2 (S1≧S2), the air streams from volute chambers 25 are apt to be released through first exhaust openings 7 having less flow resistance; therefore, the overall pressure loss of the air stream can be reduced, thereby improving air suction efficiency.

Further, by setting S1 to be smaller than total area S3 of air paths C between air guide 5 and casing 6 (S1<S3), the flow of the air streams from volute chambers 25 toward motor unit 2 is facilitated, thereby efficiently suppressing the rise in temperature of motor unit 2 which tends to be hot.

On the other hand, if S1 is set to be equal to or larger than S3 (S1≧S3), the air streams from volute chambers 25 can be readily released through first exhaust openings 7. As a result, the overall pressure loss of the air stream is reduced, thereby improving air suction efficiency.

Further, in case total area S1 of first exhaust openings 7, total area S3 of air paths C between air guide 5 and casing 6 and total area S5 of second exhaust openings 9 are set to be S1≦S3≦S5, the air streams from volute chambers 25 are apt to flow into electric motor 8, thereby suppressing the rise in temperature of electric motor 8.

In case total area S4 of air path 8*a* between second bracket 14 and electric motor 8 is set to satisfy relationship S1≦S3≦S4≦S5, the airflows from volute chambers 25 can more easily flow toward electric motor 8, thereby resulting in more efficient cooling of electric motor 8.

Figure 4:
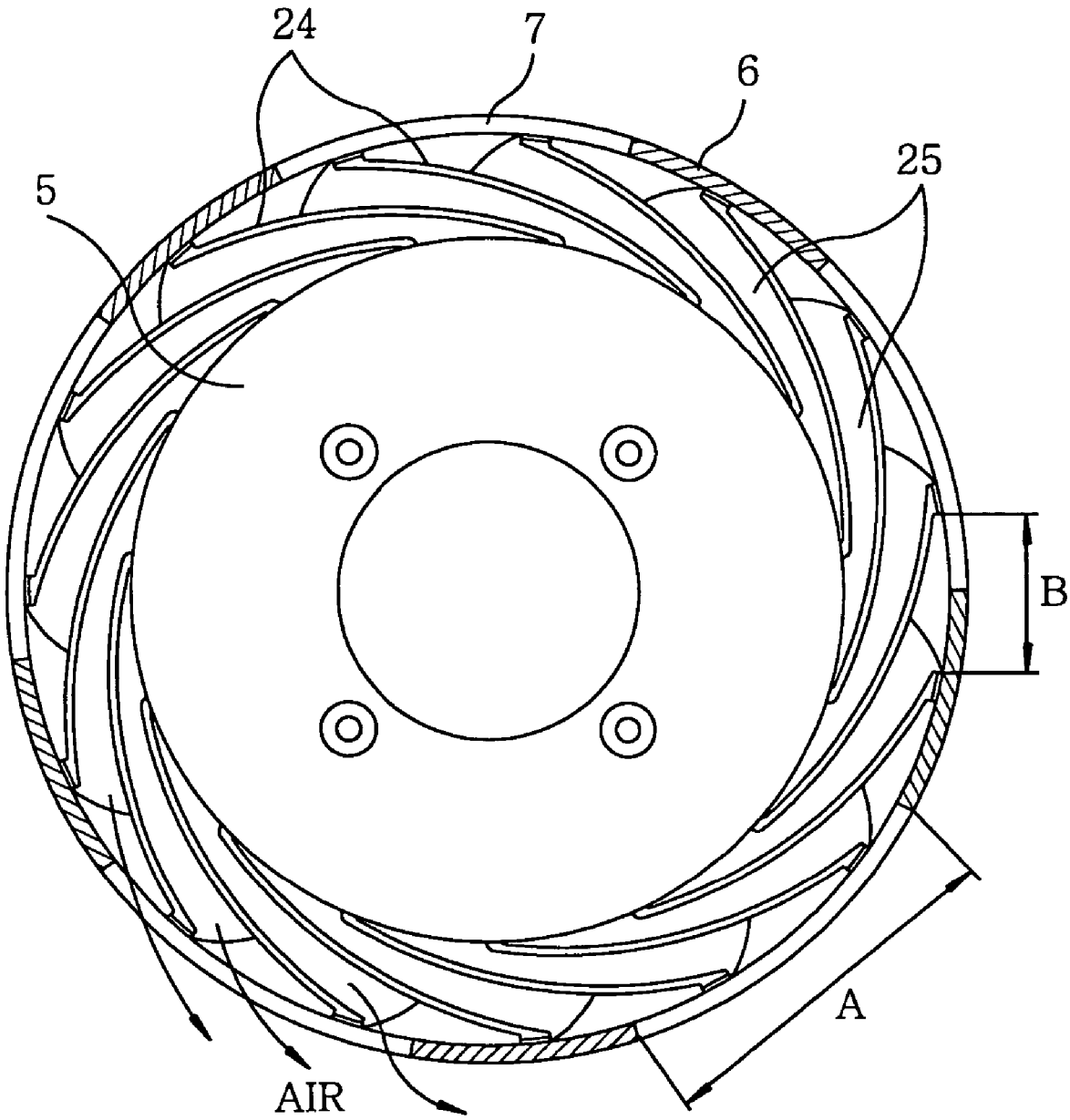
FIG. 4 depicts a cross sectional view (taken along line C-C in FIG. 1) describing a positional relationship between the guide blades and the first exhaust openings in an electric blower in accordance with a third preferred embodiment of the present invention.
Figure 5:
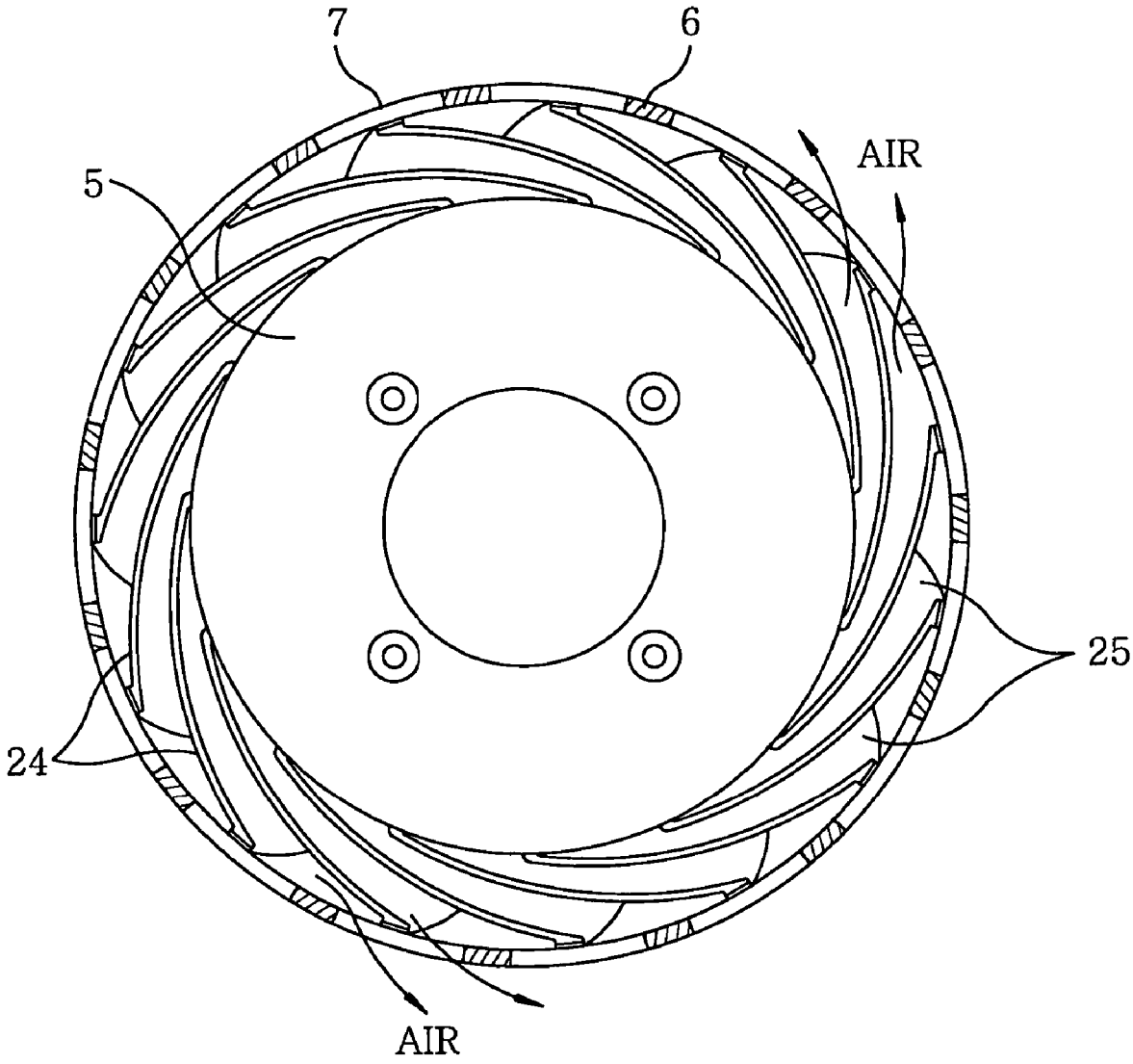
FIG. 5 offers a cross sectional view (taken along line C-C in FIG. 1) describing an exemplary positional relationship between the guide blades and the first exhaust openings in an electric blower in accordance with the third preferred embodiment of the present invention.

Next, a third preferred embodiment of the present invention will now be described with reference to FIG. 4. Detailed explanations of parts that are identical or similar to those in the previous embodiments will be omitted, and like reference numerals will be imparted thereto. In this preferred embodiment, circumferential length A of each of first exhaust openings 7 formed in casing 6 is set to be larger than circumferential distance B between the outer peripheral ends of every two adjacent guide blades 24. Further, two side edges of each of first exhaust openings 7 are located at about the center portions of corresponding volute chambers 25, respectively.

With the electric blower in accordance with the third preferred embodiment, since circumferential length A of each of first exhaust openings 7 is set to be larger than circumferential distance B between the outer peripheral ends of every two adjacent guide blades 24 and volute chambers 25 are disposed in such a way that the air streams from a plurality of, e.g., three, volute chambers 25 are discharged through one of first exhaust openings 7, the air streams passing through the three of volute chambers 25 are released through a same first exhaust opening 7 while interfering with each other, so that high frequency sounds or noises, which tend to be increased when the air streams are directly discharged through first exhaust openings 7, can be reduced or eliminated.

The same effects may be obtained by installing guide blades 24 of air guide 5 in a manner that outer peripheral ends thereof are located at the center portions of first exhaust openings 7, respectively, or by providing a gap between the outer periphery of air guide 5 and the inner periphery of casing 6 to generate a circular airflow therethrough.

Figure 6:
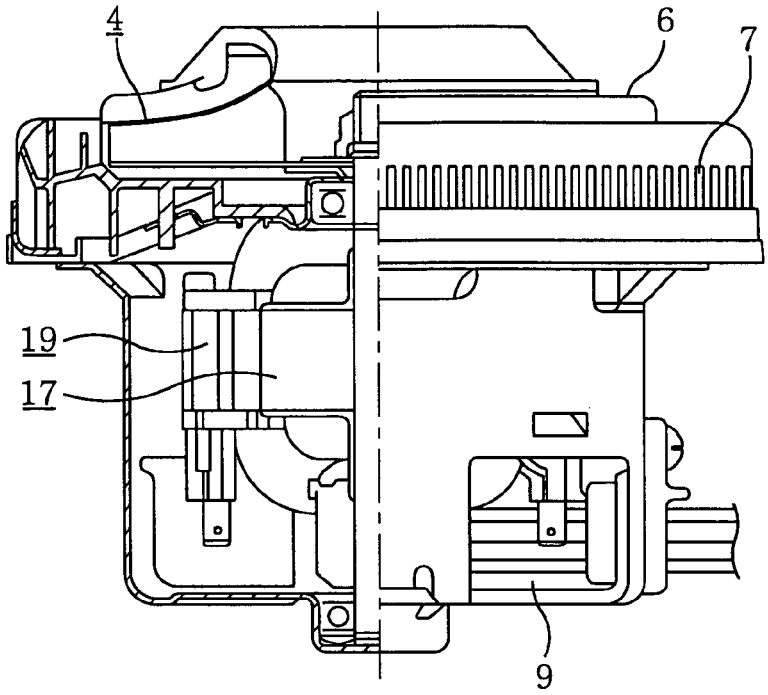
FIG. 6 shows a half cutaway cross sectional view of another exemplary electric blower in accordance with the present invention.
Figure 7:
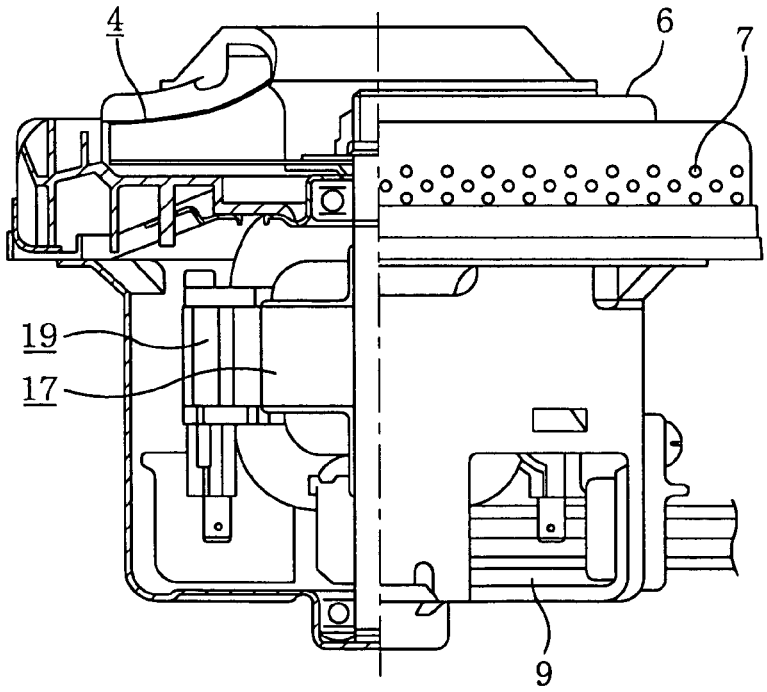
FIG. 7 illustrates a half cutaway cross sectional view of an alternative electric blower in accordance with the present invention.

Likely, first exhaust openings 7 formed in casing 6 may be a multiplicity of slits as shown in FIG. 6 or plural small holes as shown in FIG. 7 to obtain the same effects.

Figure 8:
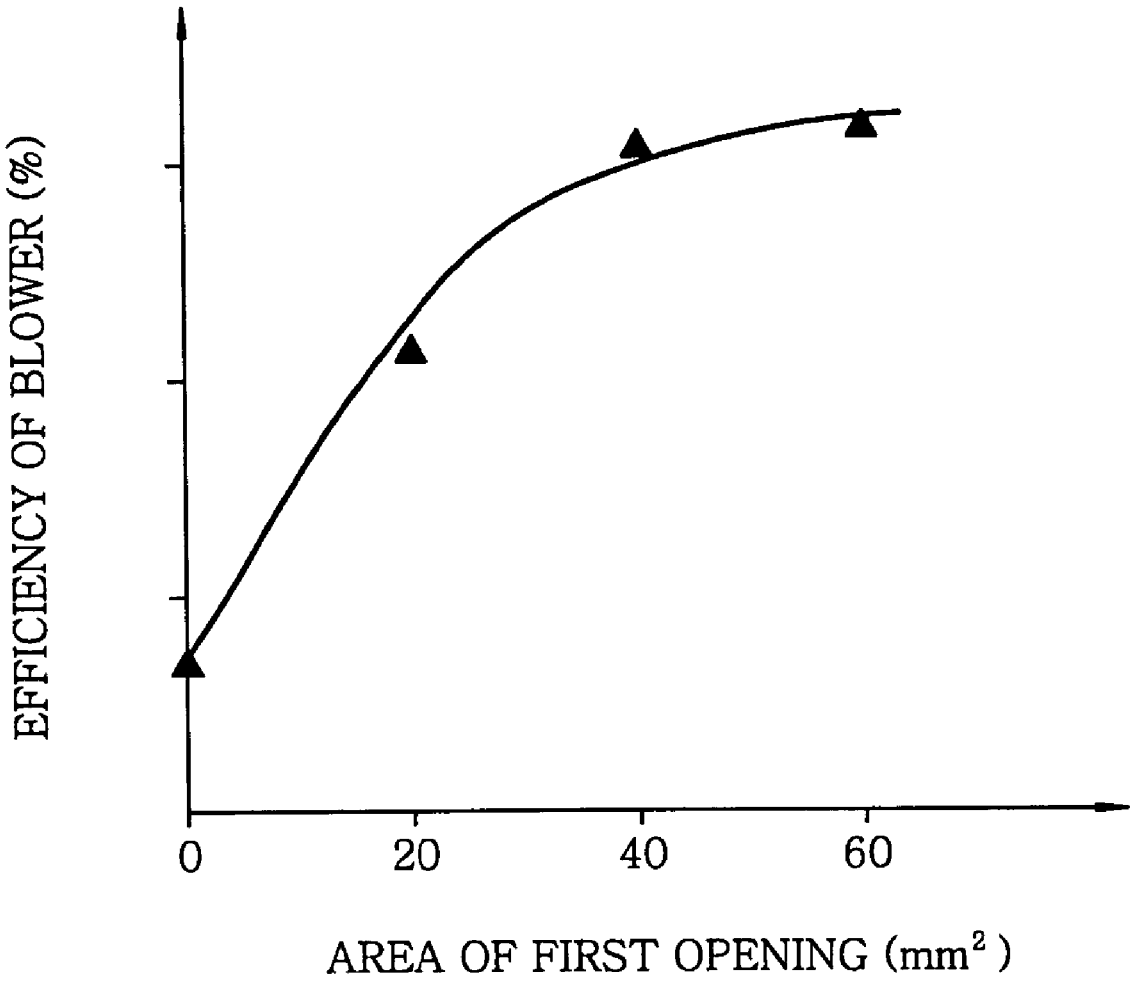
FIG. 8 presents a graph describing a relationship between an air blowing efficiency of an electric blower and an area of each of the first exhaust openings thereof in accordance with a fourth preferred embodiment of the present invention.

A fourth preferred embodiment of the present invention will now be described hereinafter with reference to FIG. 8. Like parts from the previous preferred embodiments will be assigned like reference numerals and detailed descriptions thereof will be omitted.

The area of each of first exhaust openings 7 formed in casing 6 is set to be about 40 $mm^2$ or greater.

As described above, the blowing efficiency of the electric blower may be improved by virtue of reduction of the fluidic losses augmented as the area of first exhaust openings 7 provided in casing 6 increases. However, if the opening area thereof is greater than about 40 $mm^2$, the efficiency of the electric blower is saturated, as can be seen from FIG. 8 showing a relationship between the area of each of first exhaust openings 7 and the blowing efficiency.

Figure 9:
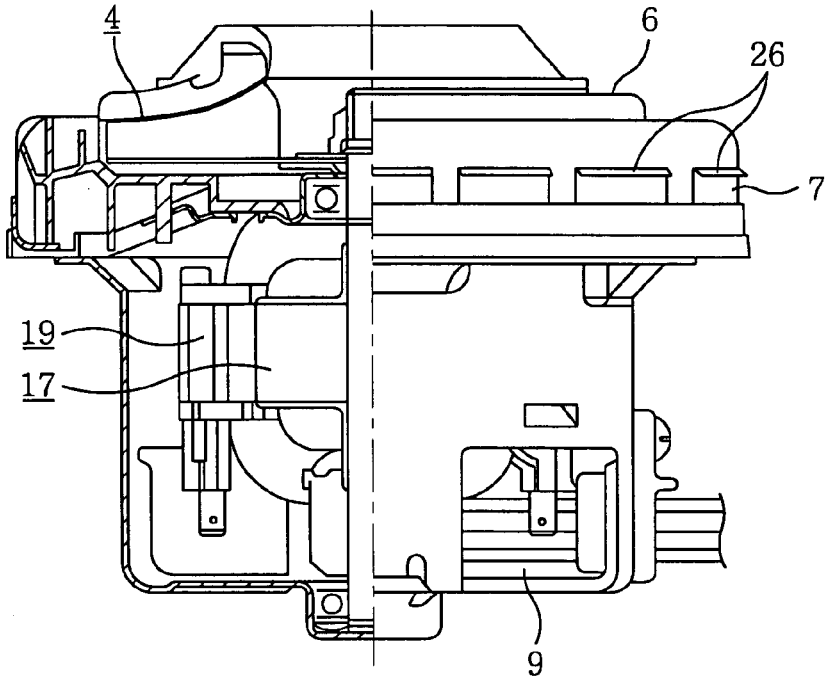
FIG. 9 is a half cutaway cross sectional view of an electric blower in accordance with a fifth preferred embodiment of the present invention.

Next, a fifth preferred embodiment of the present invention will be described with reference to FIG. 9. Detailed explanations of parts that are identical or similar to those in the previous embodiments will be omitted, and like reference numerals will be assigned thereto.

Ribs 26 are installed on outer surface of casing 6 immediately above first exhaust openings 7 formed along the periphery of casing 6, respectively.

Ribs 26 serve to prevent dispersion of air streams discharged through first exhaust openings 7 and guide the flow of the air streams toward motor unit 2. That is, the air streams discharged from first exhaust openings 7 are forced to flow downward by ribs 26. As a result, airflow becomes smooth and the volume of exhausted air streams through first exhaust openings 7 can be increased, thereby reducing fluidic losses of the airflow in the electric blower to enhance the blowing efficiency thereof.

Figure 10:
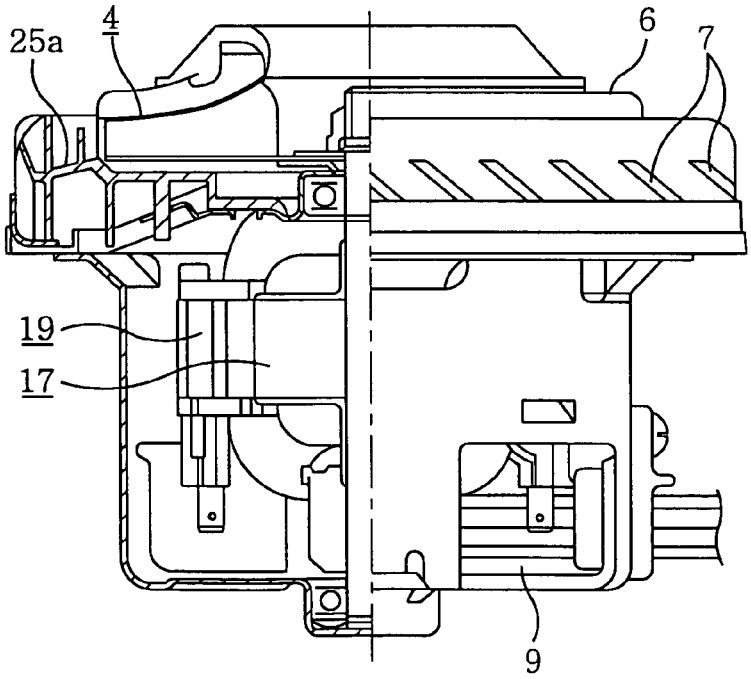
FIG. 10 represents a half cutaway cross sectional view of an electric blower in accordance with a sixth preferred embodiment of the present invention.

Next, a sixth preferred embodiment of the present invention will be described in detail in connection with FIG. 10, in which like parts from the previous embodiments will be designated with like reference numerals, and detailed explanations thereof will be omitted.

In this embodiment, a slope of side edges of each of first exhaust openings 7 having a substantially quadrilateral shape, e.g., parallelogrammic shape, is set to be substantially identical with a slope of bottom surface 25*a* of each of volute chambers 25 defined by adjacent guide blades 24 in air guide 5.

Since first exhaust openings 7 are formed in casing 6 with their side edges tilted at an angle substantially identical to that of the air streams discharged from volute chambers 25, the flow of the air streams becomes smooth.

Figure 11:
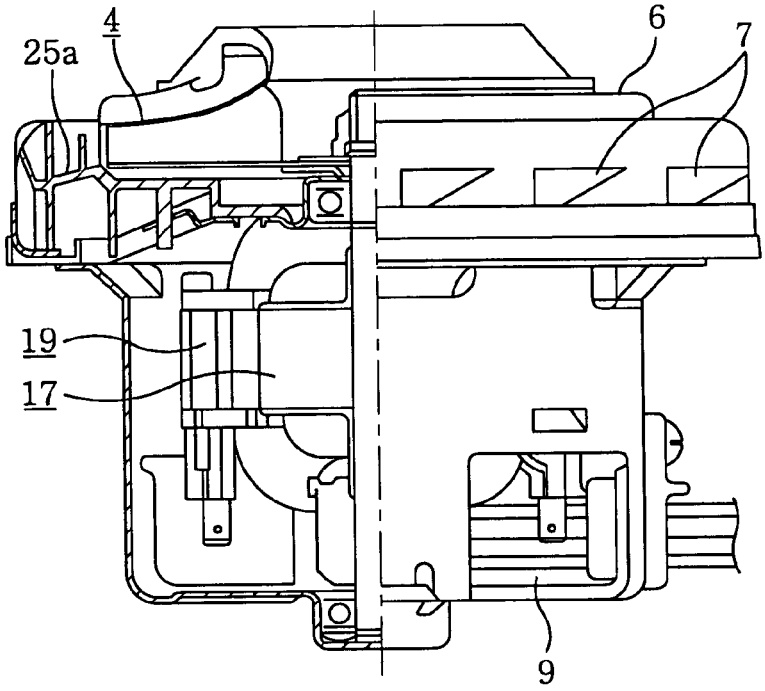
FIG. 11 provides a half cutaway cross sectional view of a still another exemplary electric blower in accordance with the present invention.

As a result, the volume of the exhausted air streams through first exhaust openings 7 can be increased as in the fifth preferred embodiment, thereby reducing the fluidic losses of the air stream to enhance the blowing efficiency thereof. The same effects can be obtained by tilting a side edge of substantially quadrilateral shaped, e.g., trapezoid shaped, first exhaust openings 7 with respect to the length direction of rotation shaft 3 to reduce the area of first exhaust openings 7, as shown in FIG. 11.

Figure 12:
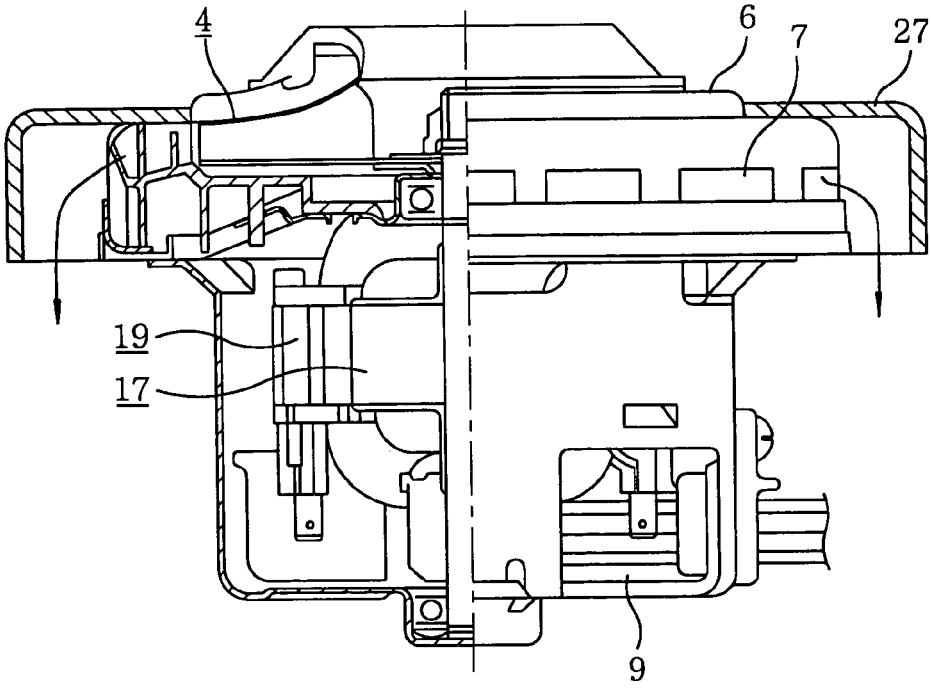
FIG. 12 sets forth a half cutaway cross sectional view of an electric blower in accordance with a seventh preferred embodiment of the preset invention.
Figure 13:
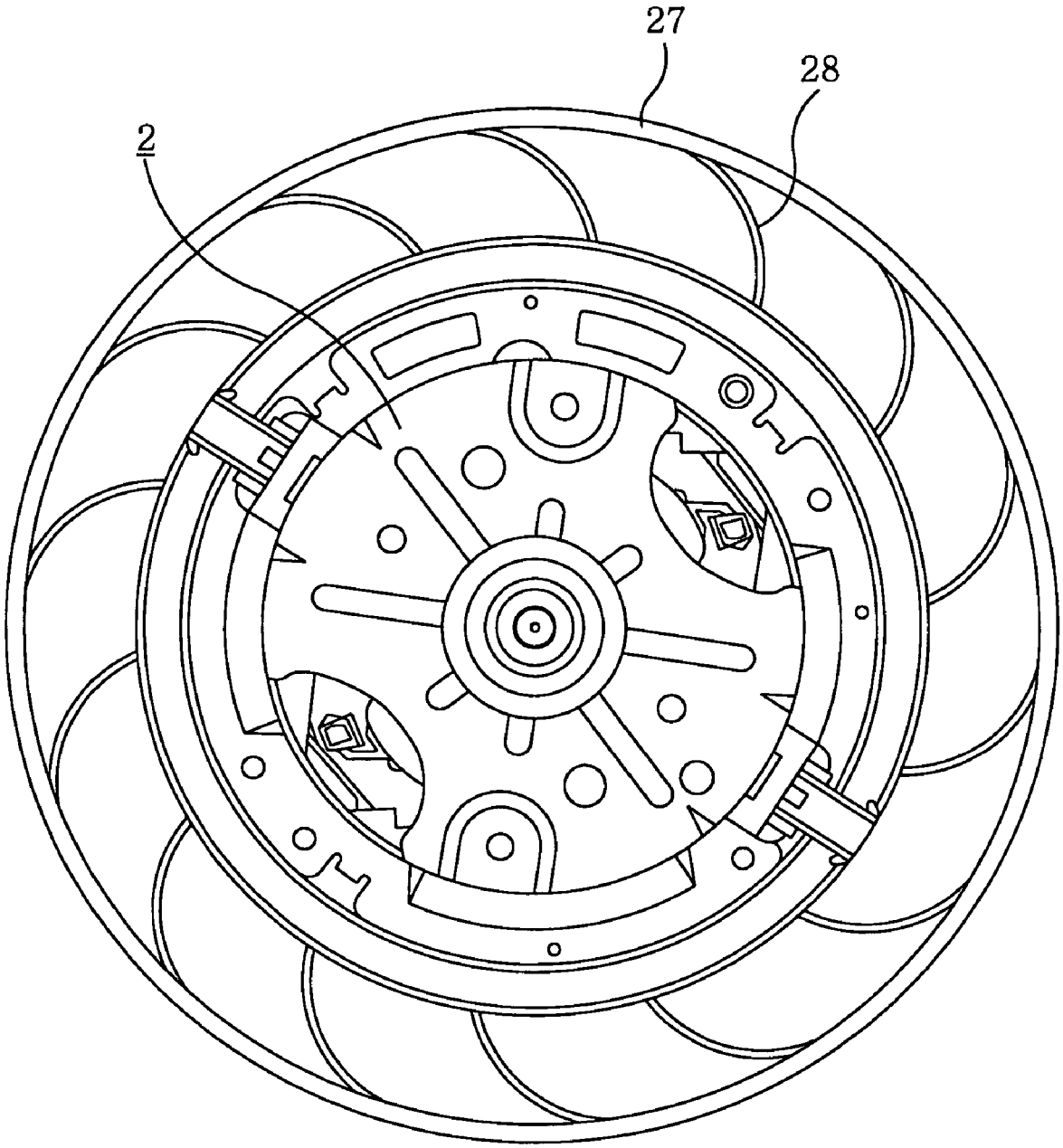
FIG. 13 describes an exemplary bottom view of an electric blower in accordance with the present invention.

Next, a seventh preferred embodiment of the present invention will be described with reference to FIG. 12. Detailed explanations of parts identical or similar to those in the previous embodiments will be omitted, and the like reference numerals will be used therefor.

Motor cover 27 having an opened bottom toward motor unit 2 is installed to cover first exhaust openings 6 so that the air streams discharged from first exhaust openings 7 can be guided to flow downward to motor unit 2.

Since motor cover 27 disposed surrounding casing 6 serves to prevent dispersion of the air streams discharged from first exhaust openings 7, the air streams smoothly flow toward motor unit 2. Consequently, the volume of the exhausted air streams is increased with their fluidic losses reduced, thereby improving the blowing efficiency.

Further, by installing scroll blades 28 at motor cover 17 at locations corresponding to first exhaust openings 7, the blowing efficiency of the electric blower can be further increased.

Though first exhaust openings 7 are formed at casing 6 in the above-described preferred embodiments of the present invention, they may be formed at any part which encloses impeller 4 and air guide 5, e.g., first bracket 12 being in contact with lower portions of impeller 4 and air guide 5.

Next, an eighth preferred embodiment of the present invention will be described hereinafter with reference to FIGS. 14 to 17.

Figure 14:
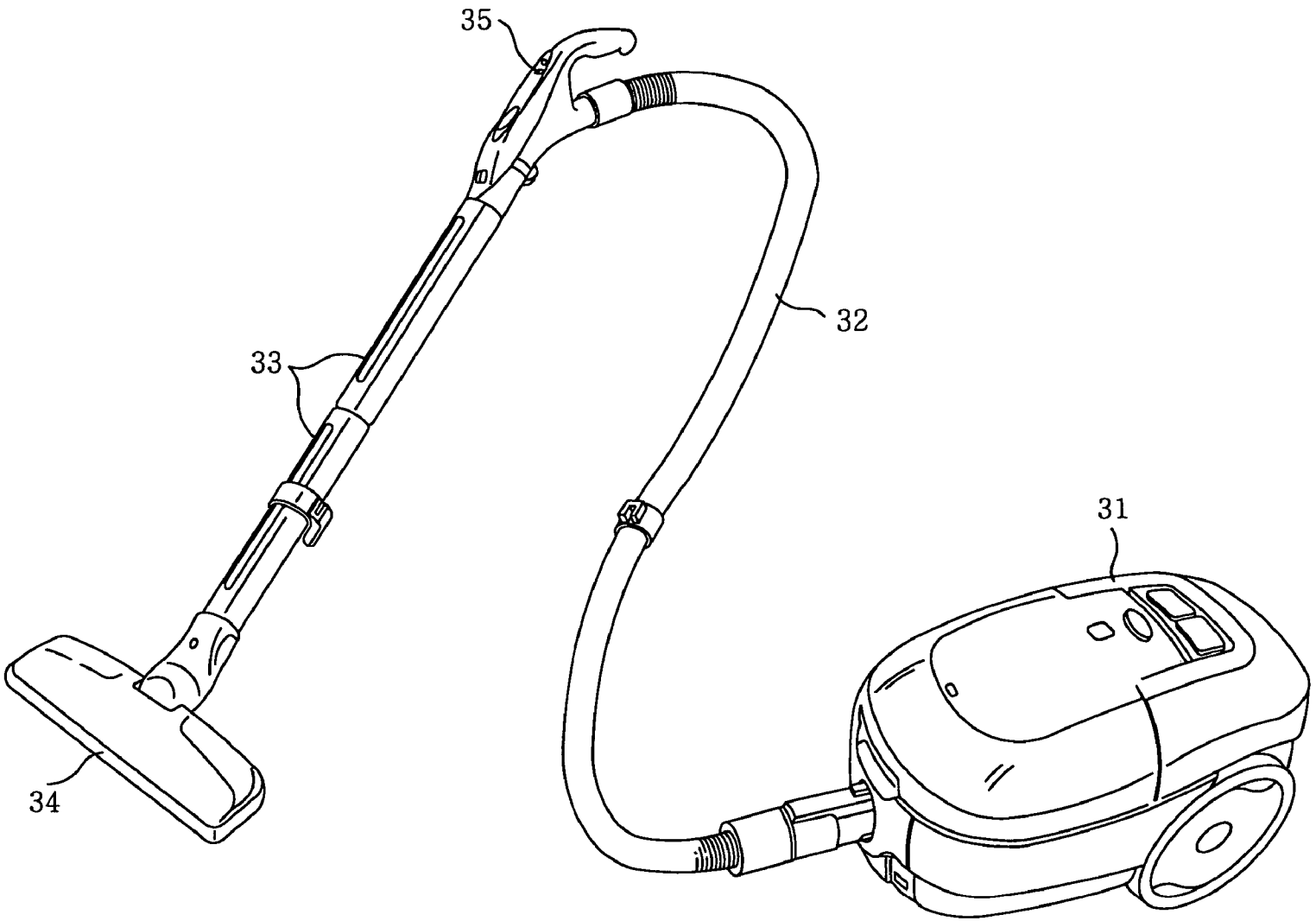
FIG. 14 illustrates an overall view of a vacuum cleaner in accordance with an eighth preferred embodiment of the present invention.
Figure 15:
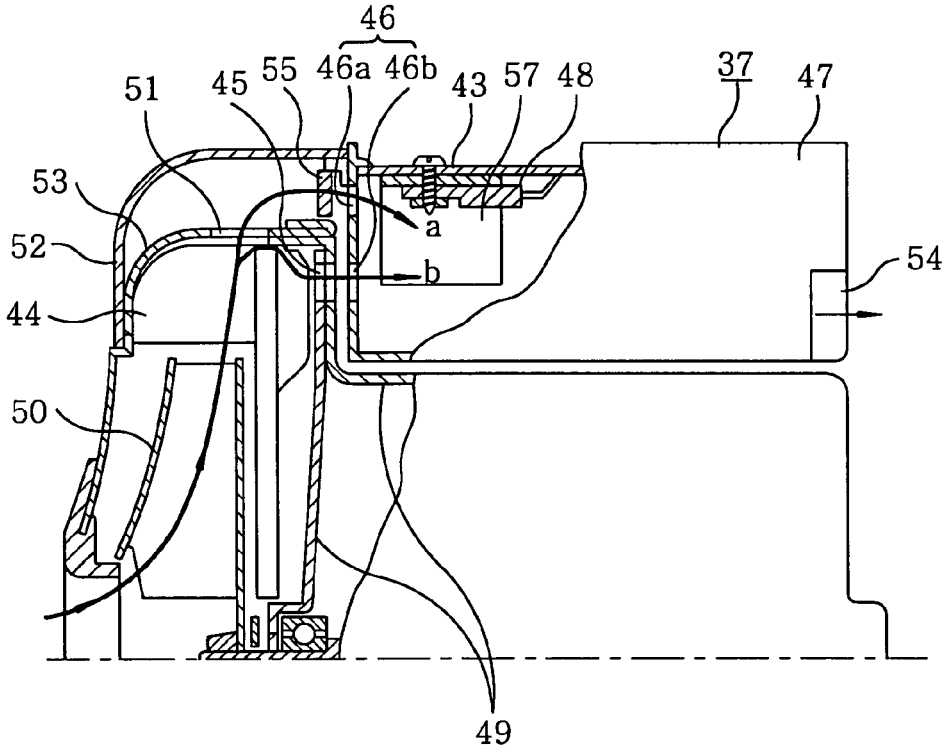
FIG. 15 represents a partial cutaway cross sectional view of an electric blower employed in a vacuum cleaner in accordance with the present invention.

FIG. 14 is an overall perspective view of a vacuum cleaner.

Reference numeral 31 is a main body of the vacuum cleaner. Incorporated in blower housing chamber 38 within main body 31 is electric blower 37 for generating suction air stream. Further, disposed upstream of electric blower 37 is dust collecting chamber 36 incorporating therein dust bag 42, made of, e.g., a paper bag, for collecting dirt particles therein. The suction air stream generated by electric blower 37 uplifts the dirt particles through suction unit 34, and the dirt-laden air travels through air passages (not shown) within extension tube 33 and hose 32, finally reaching dust bag 42. As a result, the dirt particles are collected and trapped therein. The dirt-free air discharged from electric blower 37 is released through ventilating grill 39 provided on a rear portion of main body 31. Reference numeral 35 is a manipulation handle for controlling power consumption of electric blower 37 and reference numerals 40 and 41 represent a prefilter and an exhaust filter, respectively.

Electric blower 37 includes impeller 50 for generating the suction air stream by rotation thereof, casing 53 enclosing impeller 50, and a plurality of third exhaust openings 51 formed at casing 53 through which a part of the suction air stream generated by impeller 50 is discharged. Further, mounted on exhaust air path 58 extended from third exhaust openings 51 to ventilating grill 39 is control board 42 for controlling the operation of electric blower 37 (input control) and/or heat generating device(s) 48. Such configuration enables the air streams discharged from third exhaust openings 51 to be used to cool down control board 43 and/or heat generating device(s) 48.

Since third exhaust openings 51 are formed in casing 53 which encloses impeller 50 without supporting weighty parts, the existence of third exhaust openings 51 in casing 53 does not cause reduction of rigidity of electric blower 37. As a result, the cooling of control board 43 and/or heat generating device(s) 48 can be efficiently conducted without deteriorating reliability of electric blower 37.

Basically, the rigidity of electric blower 37 is determined by strength of brackets 49, including the one close to the load and the one at the opposite side thereof, for supporting a stator (not shown) and a rotor (not shown). Casing 53 has a thickness of about 0.3 mm to 0.5 mm, thinner than that of bracket 49 ranging from about 0.8 mm to 1.0 mm, because casing 53 is designed just to enclose impeller 50 and air guide 44 for the purpose of improving efficiency. Accordingly, the presence of third exhaust openings 51 in casing 53 does not cause any reduction of the rigidity of electric blower 37 and occurrence of abnormal sparks and vibrations that might be incurred by the reduction of rigidity of electric blower 37. Rather, exhaust openings 51 allow for effective cooling of control board 43 and/or heat generating device(s) 48.

The cooling efficiency can be further improved by forming in brackets 49 one or more fourth exhaust openings 45 for discharging a part of the suction air stream generated by impeller 50, brackets 49 being installed downstream of impeller 50 in a manner than one of them is in contact with a peripheral bottom portion of air guide 44 and the other forms a case of electric blower 37. The presence of fourth exhaust openings 45 in brackets 45, however, may result in reduction in the rigidity of electric blower 37. Therefore, the number and the shape of fourth exhaust openings 45 should be limited to be adequate for specifications of electric blower 37 by measuring a resonance frequency thereof.

Control board 43 and/or heat generating device(s) 48 accommodated in cover body 47 made of, e.g., resin, are disposed in exhaust air path 58 extended from third exhaust openings 51 in casing 53 to ventilating grill 39. In this preferred embodiment, cover body 47 is fitedly mounted to electric blower 37, e.g., brackets 49 of electric blower 37 via one or more screws. Accordingly, the air streams from third exhaust openings 51 or fourth exhaust openings 45 can efficiently flow to control board 43 and/or heat generating device (s) 48 for the stabilized cooling thereof.

Further, by forming air inlets 46 in cover body 47 for introducing the air streams from third exhaust openings 51 and fourth exhaust openings 45 into cover body 47, control board 43 and/or heat generating device(s) 48 therein can be stably cooled down. Furthermore, since air inlets 46 include one or more first air inlets 46*a* and one or more second air inlets 46*b* separately prepared for introducing only the air streams from third exhaust openings 51 and fourth exhaust openings 45, respectively, the air streams therefrom can be further efficiently utilized.

Further, by installing air outlet 54 in cover body 47 through which the air streams introduced into cover body 47 are discharged after passing through control board 43 and/or heat generating device(s) 48, the airflow can smoothly pass through cover body 47. Furthermore, air outlet 54 allows dirt particles that are introduced in cover body 47 without being trapped by dust bag 42 to be discharged therethrough, thereby preventing accumulation of the dirt particles in cover body 47 and, hence, improving the reliability of control board 43 and/or heat generating device(s) 48.

For the improvement of reliability against dirt particles, filter 55 may be disposed between air inlets 46 of cover body 47 and third exhaust openings 51 or fourth exhaust openings 45, thereby preventing the dirt particles from entering cover body 47 to further improve the reliability of control board 43 and/or heat generating device(s) 48.

It is preferable to locate heat generating device(s) 48, e.g., a triac of control board 43, in the vicinity of air inlets 46 in cover body 47, for such arrangement facilitates the cooling thereof. Further, a radiation part such as fins 57 can be affixed to heat generating device(s) 48 by screws for example in order to improve the cooling efficiency of heat generating device(s) 48.

Since the air streams are discharged from third exhaust openings 51 in casing 53 in a centrifugal direction of impeller 50 (i.e., a radial direction of electric blower 37) at a high speed, the air streams may not be smoothly introduced into cover body 47 through air inlets 46*a*. Therefore, by forming an air flow path by way of installing guide 52 enclosing the periphery of casing 53 up to cover body 47, the air streams from third exhaust openings 51 can be smoothly introduced into cover body 47 via air inlets 46*a*.

Figure 16:
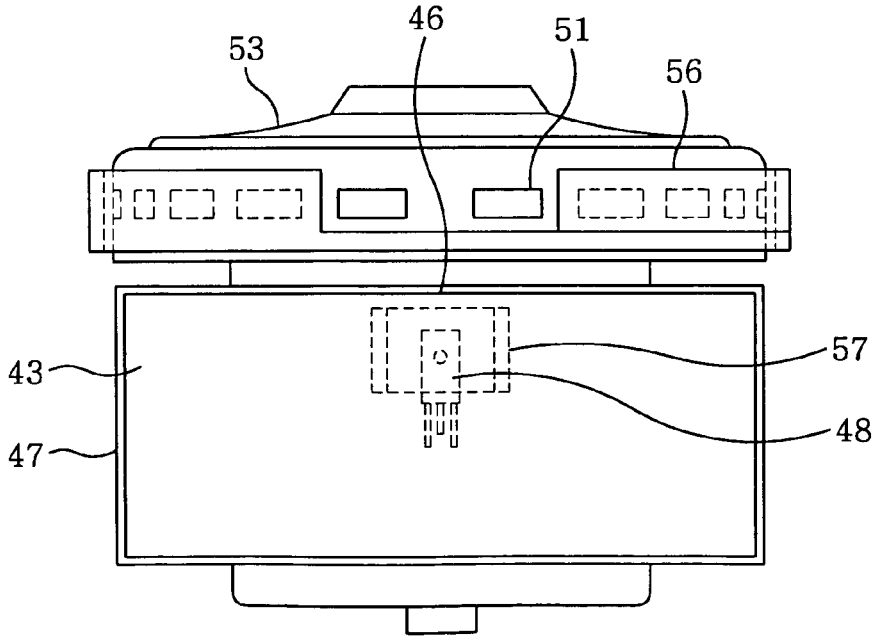
FIG. 16 is a front view of an electric blower having a noise reduction member attached thereto.
Figure 17:
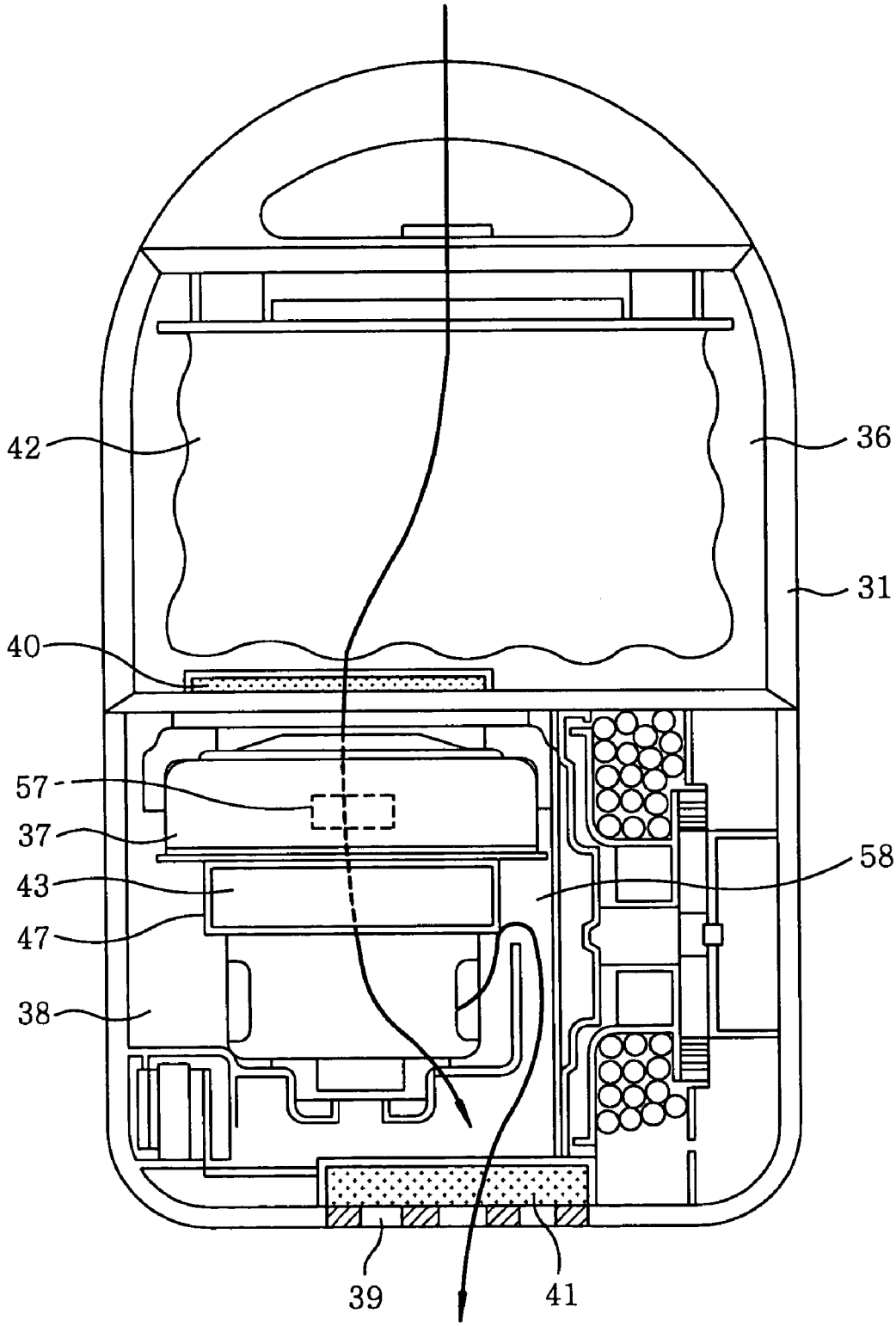
FIG. 17 is a cross sectional view of a main body of the vacuum cleaner.

Further, since third exhaust openings 51 are formed along the circumference of casing 53, a considerable amount of noises generated by impeller 50 are released outside without being reduced. Thus, noise reduction plate 56 may be installed along the circumference of casing 53 in order to reduce the noise level. In such a case, however, there may occur a problem that the volume of the air stream introduced into cover body 47 is reduced by the presence of noise reduction plate 56. Therefore, as shown in FIG. 16, it is preferable to provide noise reduction plate 56 on casing 53 not to include the regions on which there reside third exhaust openings 51 for discharging the air streams to be introduced into cover body 47. In this way, the cooling efficiency can be increased while achieving noise reduction. While the invention has been shown and described with respect to the preferred embodiment, it will be understood by those skilled in the art that various changes and modifications may be made without departing from the spirit and scope of the invention as defined in the following claims.

What is claimed is:

1. An electric blower comprising:

an electric motor including a stator and a rotor;

an impeller being rotated by the electric motor;

an air guide having a plurality of guide blades around the impeller; and a casing enclosing the impeller and the air guide, wherein the casing is provided with a number of exhaust openings through which a part of an air stream suctioned by the impeller is discharged, and a circumferential length of each of the exhaust openings is substantially identical to a circumferential distance between outer peripheral ends of adjacent guide blades, and wherein bottom surfaces of outer peripheral end portions of volute chambers are located between lower edges and upper edges of the exhaust openings, each of the volute chambers being an air passageway formed by two neighboring guide blades, and the air stream released from the impeller passes through the volute chambers to be exhausted from an outer periphery of the air guide.

2. The electric blower of claim 1, wherein outer peripheral end portions of the volute chambers are misaligned with the exhaust openings.

3. The electric blower of claim 1, wherein a total area S1 of the exhaust openings is less than a total cross sectional area S2 of outer peripheral end portions of the volute chambers.

4. The electric blower of claim 1, wherein a total area S1 of the exhaust openings is equal to or greater than a total cross sectional area S2 of outer peripheral end portions of volute chambers, each of the volute chambers being an air passageway formed by two neighboring guide blades.

5. The electric blower of claim 1, wherein a total area S1 of the exhaust openings is less than a total cross sectional area S3 of an air path between the air guide and the casing.

6. The electric blower of claim 1, wherein a total area S1 of the exhaust openings is equal to or greater than a total cross sectional area S3 of an air path between the air guide and the casing.

7. The electric blower of claim 1, further comprising a bracket enclosing the electric motor, and wherein a total area S1 of the exhaust openings is less than a total cross sectional area S4 of an air path between the electric motor and the bracket.

8. The electric blower of claim 1, further comprising a bracket enclosing the electric motor, and wherein a total area S1 of the exhaust openings is equal to or greater than a total cross sectional area S4 of an air path between the electric motor and the bracket.

9. The electric blower of claim 1, further comprising a bracket enclosing the electric motor, the bracket having at least one outlet opening through which air supplied therein from the impeller is discharged outside.

10. The electric blower of claim 9, wherein a total area S1 of the exhaust openings is less than a total area S5 of the outlet opening.

11. The electric blower of claim 9, wherein a total area S1 of the exhaust openings is equal to or greater than a total area S5 of the outlet opening.

12. The electric blower of claim 9, wherein a total area S1 of the exhaust openings, a total cross sectional area S3 of an air path between the air guide and the casing, and a total area S5 of the outlet opening satisfy the following relationship: $S1 \leqq S3 \leqq S5$.

13. The electric blower of claim 9, wherein a total area S1 of the exhaust openings, a total cross sectional area S3 of an air path between the air guide and the casing, a total area S4 of an air path between the electric motor and the bracket, and a total area S5 of the outlet opening satisfy the following relationship: $S1 \leqq S3 \leqq S4 \leqq S5$.

14. The electric blower of claim 1, wherein a total area S1 of the exhaust openings is set to be 40 $mm^2$ or greater.

15. The electric blower of claim 1, wherein there is provided a gap between an outer periphery of the air guide and an inner periphery of the casing.

16. The electric blower of claim 1, wherein each of the guide blades is located at about a center of a circumferential width of an exhaust opening.

17. The electric blower of claim 1, wherein ribs are provided on an outer surface of the casing above the respective exhaust openings.

18. The electric blower of claim 1, wherein side edges of each of the exhaust openings are inclined at an angle substantially identical to that of bottom surfaces of volute chambers.

19. The electric blower of claim 1, wherein a side edge of each of the exhaust openings is inclined with respect to a longitudinal direction of a rotation shaft of the electric motor.

20. The electric blower of claim 1, wherein the number of the volute chambers is the same as that of the exhaust openings.

21. The electric blower of claim 1, wherein each of the exhaust openings is generally of a quadrilateral shape, and a side edge of each of the exhaust openings is inclined with respect to a longitudinal direction of a rotation shaft of the electric motor.

22. The electric blower of claim 1, further comprising a motor cover surrounding the casing, wherein the motor cover covers the exhaust openings, the motor cover being open at a downstream side of the part of the air stream.

* * * * *